US005685132A

United States Patent [19]

Romijn et al.

[11] Patent Number: 5,685,132

[45] Date of Patent: Nov. 11, 1997

[54] BAG FORMING, FILLING AND SEALING MACHINE

[75] Inventors: Barend Baastian Romijn, Weert; Alfred Wijkhuizen, Nuenen, both of Netherlands

[73] Assignee: Robert Bosch GmbH, Stuttgart, Germany

[21] Appl. No.: 640,963

[22] PCT Filed: Sep. 6, 1995

[86] PCT No.: PCT/DE95/01206

§ 371 Date: May 9, 1996

§ 102(e) Date: May 9, 1996

[87] PCT Pub. No.: WO96/07589

PCT Pub. Date: Mar. 14, 1996

[30] Foreign Application Priority Data

Sep. 10, 1994 [DE] Germany ..... 44 32 261.5

[51] Int. Cl.[6] ..... B65B 9/20; B65B 9/22

[52] U.S. Cl. ..... 53/551; 493/295; 493/302

[58] Field of Search ..... 53/550, 551, 552, 53/450, 451; 493/252, 295, 296, 302

[56] References Cited

U.S. PATENT DOCUMENTS

| | | | |
|---|---|---|---|
| 3,324,534 | 6/1967 | Spurk | 493/295 X |
| 3,636,826 | 1/1972 | Bowen et al. | 53/551 X |
| 3,736,846 | 6/1973 | Frankenberg | 493/295 |
| 3,785,112 | 1/1974 | Leasure et al. | 53/551 X |
| 4,079,662 | 3/1978 | Puccetti et al. | 53/552 |
| 4,505,769 | 3/1985 | Auckenthaler | 493/302 X |
| 4,905,349 | 3/1990 | Townsend | 53/550 X |
| 4,908,009 | 3/1990 | Yokoyama | 493/295 X |
| 4,986,054 | 1/1991 | McMahon | 53/552 X |
| 5,505,040 | 4/1996 | Janssen et al. | 53/551 X |

*Primary Examiner*—Horace M. Culver

*Attorney, Agent, or Firm*—Edwin E. Greigg; Ronald E. Greigg

[57] ABSTRACT

A bag forming, filling and sealing machine for producing bag packages with a base or block bottom comprising a forming tube whose lower part has two segments that accomplish a transition from a circular inlet cross section to a rectangular outlet cross section via a square intermediate cross section. As a result of the intermediate cross section, differences in length longitudinally along the jacket lines from the circular inlet cross section to the rectangular outlet cross section of the forming tube are virtually equalized. As a result, bulging and corrugation of the packaging material at the side faces of the bag packages is virtually precluded.

18 Claims, 3 Drawing Sheets

Fig. 4
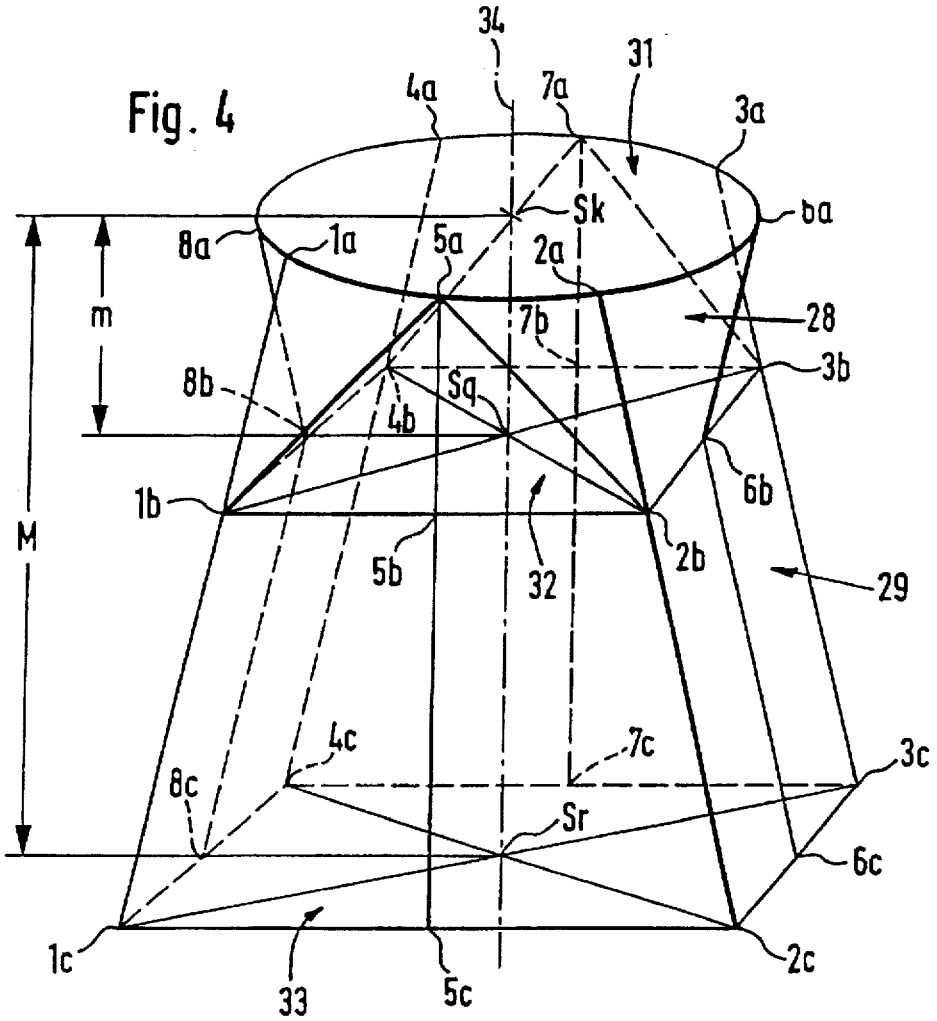
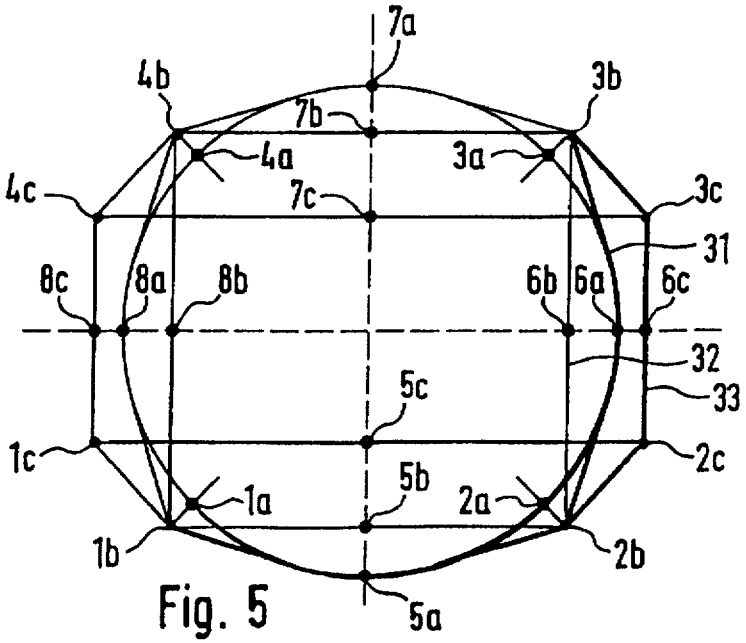
Fig. 5

BAG FORMING, FILLING AND SEALING MACHINE

BACKGROUND OF THE INVENTION

The invention is based on a bag forming, filling and sealing machine as set forth hereinafter. In such a bag forming, filling and sealing machine, a length of packaging material is fed via a hollow forming tube and shaped into a tube. The cross section of the forming tube changes continuously, in the feeding direction of the tube, from a circular cross section to a rectangular cross section at the outlet end, on the underside of the end portion the tube is folded by a folding device to form a folded base or block bottom with side folds drawn inward in a V. A disadvantage here is that the tube is upset in the longitudinal direction along its circumference to a variable extent because of unequal-length jacket lines of the forming tube at the transition from the circular cross section to the rectangular cross section. Particularly in relatively inelastic packaging materials and packaging materials that have a high coefficient of friction, such as paper, this therefore causes corrugation and creasing, which can make sheet feeding more difficult. Depending on the packaging material and the extent of corrugation and creasing, even the appearance and tightness of the bag packages made from the tube can be impaired. There is accordingly a need for a bag forming, filling and sealing machine with which packaging materials with high coefficients of friction and those that tend to corrugation and creasing, such as paper or the like, can be processed into bag packages without creasing.

ADVANTAGES OF THE INVENTION

The bag forming, filling and sealing machine according to the invention has the advantage over the prior art that the differences in length of the jacket lines of the forming tube are minimized, and corrugation and creasing of the packaging material is thus reduced.

Further advantages and advantageous features of the invention will become apparent from the description set forth herein.

An especially slight extent of corrugation and creasing is attained if the intermediate cross section is embodied as square; in that case, the forming tube is especially simple to make. To prevent the forming tube from plugging up with the product, the lower regions of the side walls of the forming tube can be provided with recesses, or alternatively the solid-surface side walls can be replaced by suitably shaped rods.

BRIEF DESCRIPTION OF THE DRAWINGS

One exemplary embodiment of the invention is shown in the drawing and will be described in further detail in the ensuing description.

FIG. 4 is a perspective front view of the forming tube of FIG. 3, shown schematically; and FIG. 5 is a plan view of the lower portion of the forming tube.

DETAILED DESCRIPTION OF THE EXEMPLARY EMBODIMENT

Figure 1:
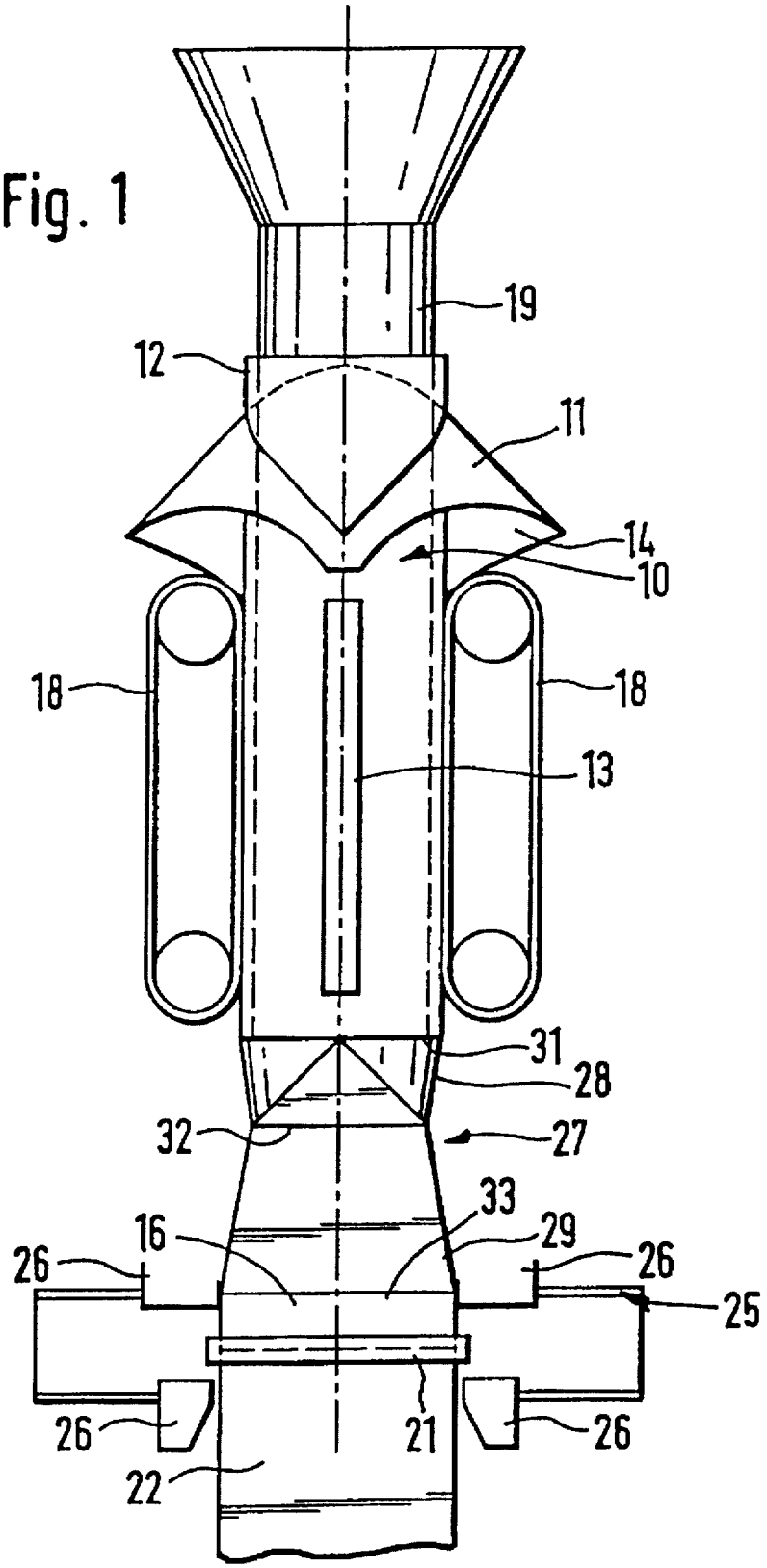
FIG. 1 is a simplified front view of a bag forming, filling and sealing machine.
Figure 3:
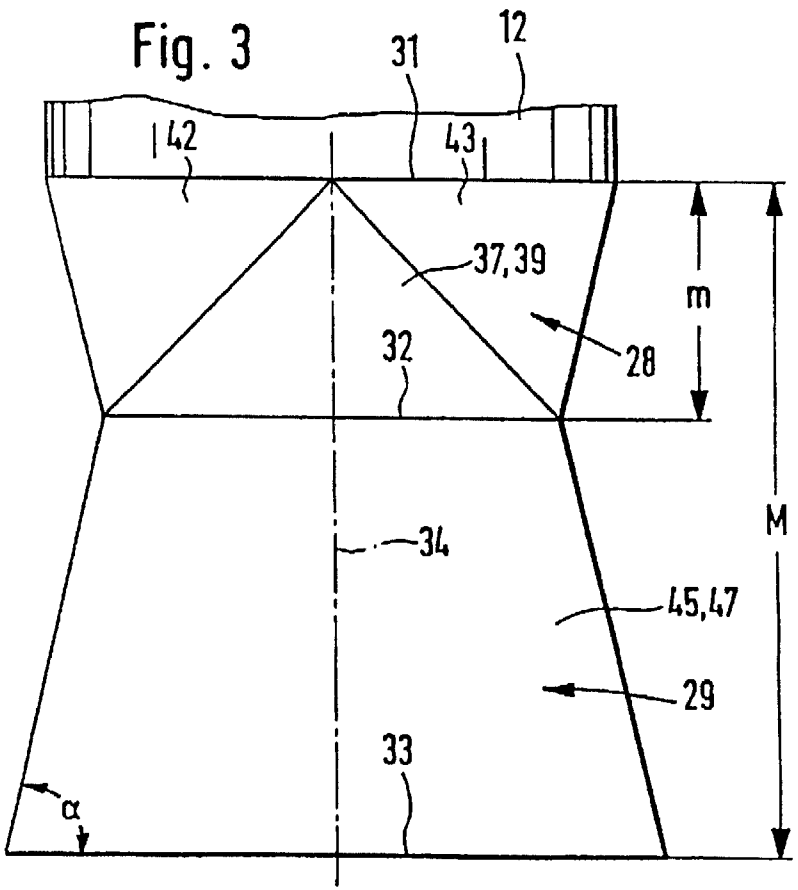
FIG. 3 is a side view of the forming tube of FIG. 2.
Figure 2:
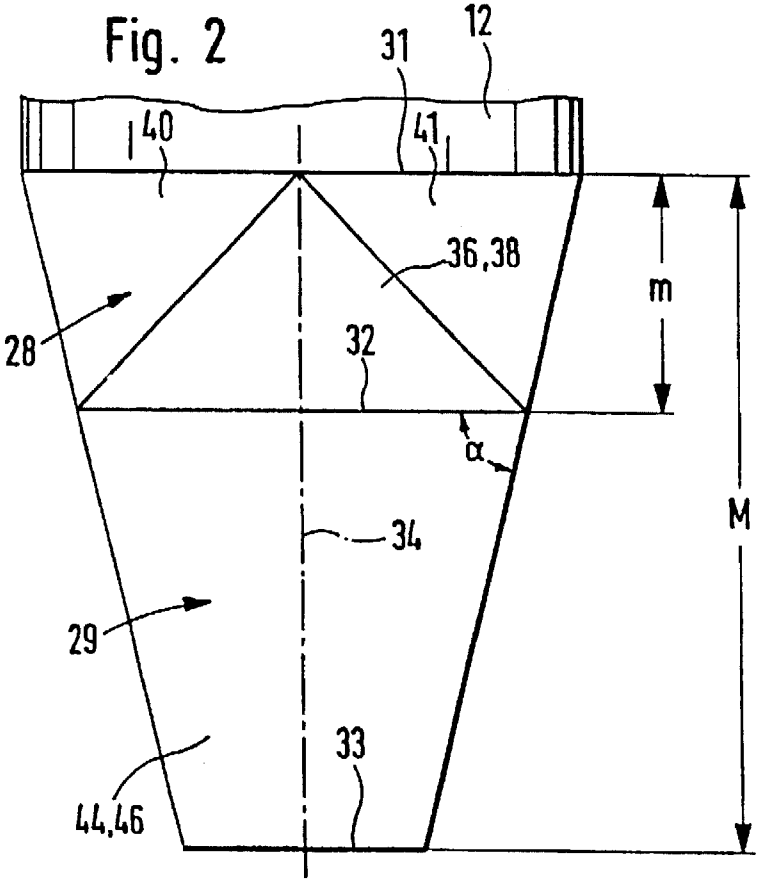
FIG. 2 is a simplified longitudinal view of the lower portion of a forming tube.

A bag forming, filling and sealing machine 10 has a forming shoulder 11 and a round, substantially hollowcylindrical forming tube 12 as well as a lengthwise seam sealing device 13, with which a sheet 14 of packaging material can be shaped in a known manner into a tube 16. On both sides of the forming tube 12, at the level of the longitudinal seam sealing device 13, a pull-off device for the tube 16 is provided, in the form of two, for instance vacuum-supported conveyor belts 18. A filling tube 19 for the material for filling the packages extends concentrically within the forming tube 12. Located below the forming tube is a combined crosswise seam sealing and cutting device 21 for sealing bag packages 22 and severing them from the tube 16. A folder device 25 with side folders 26 for folding side folds, intended in a V, in the bottom and optionally top closure of the bag package 22 and for forming a base or block bottom is also disposed above and below the crosswise seam sealing and cutting device 21.

To create a continuous transition from the circular cross section of the upper part of the forming tube to its outlet end that forms the base or block bottom, the upper part of the forming tube 12 is adjoined by a lower part 27 with two segments 28, 29. The first segment 28 has a circular inlet cross section 31, which changes into a square intermediate cross section 32 over a distance m. The second segment 29 finally changes from the square intermediate cross section 32 to a desired rectangular outlet cross section 33 that simultaneously forms the outlet end of the forming tube 12. The outlet cross section 33 is at a distance M from the inlet cross section 31. All the cross sections 31, 32, 33 of the forming tube 12 are parallel to one another, and their centers of area Sk, Sq and Sr are located on the axis of symmetry 34 of the forming tube 12. The circumferences of the cross sections 31, 32 and 33 are likewise all identical.

The first segment 28 of the lower part 27 of the forming tube 12 comprises joined-together sheet-metal parts, for instance eight such parts, 36–43. Each triangular flat part 36–39 is adjoined by a respective curved part 40–43 and vice versa, so that the most continuous possible transition from the circular inlet cross section 31 to the square intermediate cross section 32 is attained. The second segment 29 is composed of four parts 44–47, which are each trapezoidal, and as a result a continuous transition from the square intermediate cross section 32 to the rectangular outlet cross section 33 is once again attained. The two segments 28, 29 thus produced are welded together, for instance in the crosswise direction. When the segments 28, 29 are produced, it must fundamentally be assured that no sharp edges or corners whatever be created that could damage the tube 16 at the transition from one cross section to another. In a modification of the above-described mode of production, the two segments 28, 29 can for instance be made by bending of the two segments 28, 29. If the segments 28, 29 are made of some material other than sheet metal, for instance being made of plastic, it is also conceivable for the segments 28, 29 to be made from a single part.

This spacing m of the square intermediate cross section 32 from the round inlet cross section 31 is the product of the following considerations (FIG. 4):

At the transition from the round inlet cross section 31 to the rectangular outlet cross section 33, the points **1*a*–4*a* at the circumference of the round inlet cross section 31 are converted along the jacket lines of the segments 28, 29 into the corresponding corner points 1*c*–4*c* of the rectangular outlet cross section 33. If one looks at all the points on the circumference of the round inlet cross section 31, and the points corresponding to them on the outer circumference of the rectangular outlet cross section 33, then it can be seen that for reasons of geometry the jacket lines 1*a*–1*c*** through 8a–8c are of different lengths, as shown particularly clearly in FIG. 5. This is because the lengths of the jacket lines 1a–1c through 8a–8c to be traversed horizontally are of different lengths. The differences in length of the jacket lines 1a–1c through 4a–4c, in comparison with the jacket lines 5a–5c through 8a–8c, has the effect, especially in a packaging material with a high coefficient of friction or a relatively inelastic packaging material, such as paper, that feeding of the packaging material becomes much more difficult. Moreover, corrugation and creasing can occur, and can even cause disadvantages in appearance or function of the bag packages made from the packaging material.

The square intermediate cross section 32 has the least possible horizontal deviation between the round inlet cross section 31 and the rectangular outlet cross section 33. The relative deviation becomes smaller, the greater the distance between the round inlet cross section 31 and the intermediate cross section 32. The jacket lines 1b–1c through 8b–8c between the intermediate cross section 32 and the rectangular outlet cross section 33 are always of equal length. At the transition from the intermediate cross section 32 to the outlet cross section 33, an angle α in the jacket results, which becomes greater the smaller the spacing between the intermediate cross section 32 and the outlet cross section 33. An overly large angle α, however, produces an increase in the frictional resistance of the packaging material. A compromise must therefore be found with respect to the length of the segments 28, 29, so that for a given total length M, the spacing between the intermediate cross section 32 and the outlet cross section 33 is not to short. Also in the choice of the spacing between the cross sections 32 and 33, the format of the bags 22, the ratio of length to width of the outlet cross section 33, and the material with which the packages are to be filled must be taken into account.

Depending on the total length M of the segments 28, 29, it may be necessary, however, to optimize the location of the intermediate cross section 32 such that all the jacket lines 1a–1b–1c through 8a–8b–8c are of equal length, because in the arrangement just proposed for the intermediate cross section 32, the jacket lines 5a–5b–5c through 8a–8b–8c are slightly longer than the jacket lines 1a–1b–1c through 4a–4b–4c. This means that the optimal spacing m" is greater or less, by a certain amount, than the spacing m; in other words, the packaging material is stretched somewhat as well along the jacket liens 1a–1b–1c through 4a–4c–4c. However, this layout of the spacing m" requires packaging material that is elastic to a certain extent.

In order not to hinder the flow of product, it is conceivable to provide recesses that prevent the product-flow cross section from stopping up, at the parts 36–47 of the segments 28, 29, especially at the trapezoidally formed parts 44–47.

Instead of parts 36–47 preferably produced from sheet metal, suitably bent rods, disposed at least in the region of the jacket lines 1a–1b–1c through 8a–8b–8c, can be used to make the segments 28, 29; the rods are preferably round, with the smoothest possible surface.

Embodiments of the invention are not limited to a forming tube 12 that enables a transition from a round cross section to a rectangular cross section. A transition from a rounded rectangular cross section to a sharp-cornered rectangular cross section is also possible, by means of an intermediate cross section having a different ratio of length to width.

It is essential to the invention that the different lengths of the jacket lines at the circumference of the packaging material be minimized at the transition from one cross section to another, by means of an intermediate cross section.

The foregoing relates to preferred exemplary embodiments of the invention, it being understood that other variants and embodiments thereof are possible within the spirit and scope of the invention, the latter being defined by the appended claims.

What is claimed is:

1. A bag forming, filling and sealing machine (10) for producing bag packages (22) of rectangular cross section with a bottom closure and with side folds drawn in in a V made from a sheet of packaging material (14); comprising a forming tube (12) around which the sheet of packaging material (14) is formed into a tube (16), and which has a circular face in an inlet cross section (31) and a rectangular face on an outlet cross section (33), each face having the same circumference; having a folder device (25), disposed downstream of the outlet cross section (33) of the forming tube (12), for drawing side folds inward at least in a bottom region of an end segment of the tube; and having a crosswise seam sealing and cutting device (21) for forming a sealing seam in a region of the fold of the tube (16) and for cutting a filled bag package (22) off from the end segment of the tube below a rectangular outlet cross section (33) of the forming tube (12), an additional intermediate cross section (32) with the same circumference as the circular inlet cross section (31) and the rectangular outlet (33) cross-section is provided, so that the tube (16) is fed at the transition from the circular inlet cross section (31) to the rectangular outlet cross section (33) along jacket lines (1a–1b–1c through 8a–8b–8c).

2. The bag forming, filling and sealing machine of claim 1, in which the intermediate cross section (32), with respect to a center of an area (Sq) has two maximum lengths (1b–4b) and two minimum lengths (5b–8b).

3. The bag forming, filling and sealing machine of claim 2, in which the intermediate cross section (32) is embodied as square.

4. The bag forming, filling and sealing machine of claim 3, in which the forming tube (12) has a lower part (27) with two segments (28, 29), which have recesses at least in the region of the rectangular outlet cross section (33) of the forming tube (12).

5. The bag forming, filling and sealing machine of claim 4, in which the segments (28, 29) are rodlike elements, which are disposed at least in a region of the jacket lines (1a–1b–1c through 4a–4b–4c) of the forming tube segments (28, 29).

6. The bag forming, filling and sealing machine of claim 2, in which the intermediate cross section (32) is embodied rectangularly with a different ratio of length to width from the rectangular outlet cross section (33) of the forming tube (12).

7. The bag forming, filling and sealing machine of claim 6, in which the forming tube (12) has a lower part (27) with two segments (28, 29), which have recesses at least in the region of the rectangular outlet cross section (33) of the forming tube (12).

8. The bag forming, filling and sealing machine of claim 7, in which the segments (28, 29) are rodlike elements, which are disposed at least in a region of the jacket lines (1a–1b–1c through 4a–4b–4c) of the forming tube segments (28, 29).

9. The bag forming, filling and sealing machine of claim 2, in which the forming tube (12) has a lower part (27) with two segments (28, 29), which have recesses at least in the region of the rectangular outlet cross section (33) of the forming tube (12).

10. The bag forming, filling and sealing machine of claim 9, in which the segments (28, 29) are rodlike elements, which are disposed at least in a region of the jacket lines (1*a*–1*b*–1*c* through 4*a*–4*b*–4*c*) of the forming tube segments (28, 29).

11. The bag forming, filling and sealing machine of claim 1, in which the intermediate cross section (32) is embodied as square.

12. The bag forming, filling and sealing machine of claim 11, in which the forming tube (12) has a lower part (27) with two segments (28, 29), which have recesses at least in the region of the rectangular outlet cross section (33) of the forming tube (12).

13. The bag forming, filling and sealing machine of claim 12, in which the segments (28, 29) are rodlike elements, which are disposed at least in a region of the jacket lines (1*a*–1*b*–1*c* through 4*a*–4*b*–4*c*) of the forming tube segments (28, 29).

14. The bag forming, filling and sealing machine of claim 1, in which the intermediate cross section (32) is embodied rectangularly with a different ratio of length to width from the rectangular outlet cross section (33) of the forming tube (12).

15. The bag forming, filling and sealing machine of claim 14, in which the forming tube (12) has a lower part (27) with two segments (28, 29), which have recesses at least in the region of the rectangular outlet cross section (33) of the forming tube (12).

16. The bag forming, filling and sealing machine of claim 15, in which the segments (28, 29) are rodlike elements, which are disposed at least in a region of the jacket lines (1*a*–1*b*–1*c* through 4*a*–4*b*–4*c*) of the forming tube segments (28, 29).

17. The bag forming, filling and sealing machine of claim 1, in which the forming tube (12) has a lower part (27) with two segments (28, 29), which have recesses at least in the region of the rectangular outlet cross section (33) of the forming tube (12).

18. The bag forming, filling and sealing machine of claim 17, in which the segments (28, 29) are rodlike elements, which are disposed at least in a region of the jacket lines (1*a*–1*b*–1*c* through 4*a*–4*b*–4*c*) of the forming tube segments (28, 29).

* * * * *